US008912868B1

(12) United States Patent
Guyette

(10) Patent No.: US 8,912,868 B1
(45) Date of Patent: Dec. 16, 2014

(54) FIXED AND VARACTOR-TUNED BANDSTOP FILTERS WITH SPURIOUS SUPPRESSION

(75) Inventor: Andrew C. Guyette, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 241 days.

(21) Appl. No.: 13/554,592

(22) Filed: Jul. 20, 2012

Related U.S. Application Data

(60) Provisional application No. 61/510,295, filed on Jul. 21, 2011.

(51) Int. Cl.
*H01P 1/203* (2006.01)
*H01P 7/08* (2006.01)

(52) U.S. Cl.
CPC ..... *H01P 1/203* (2013.01); *H01P 7/088* (2013.01)
USPC ..... 333/205; 333/235

(58) Field of Classification Search
CPC ..... H01P 1/203; H01P 1/20363; H01P 7/082; H01P 7/08
USPC ..... 333/204, 205, 219, 235
See application file for complete search history.

(56) References Cited

U.S. PATENT DOCUMENTS 6,194,981 B1 * 2/2001 Henderson et al. ..... 333/204
8,305,164 B1 * 11/2012 Jachowski ..... 333/205

OTHER PUBLICATIONS

R. Levy, R. V. Snyder, and S. Shin, "Bandstop filters with extended upper passbands," IEEE Trans. Microwave Theory Tech., vol. 54, pp. 2503-2515 (Jun. 2006).

* cited by examiner

*Primary Examiner* — Robert Pascal
*Assistant Examiner* — Gerald Stevens
(74) *Attorney, Agent, or Firm* — US Naval Research Laboratory; L. George Legg

(57) ABSTRACT

A bandstop filter configured to suppress a spurious resonance frequency includes a resonator and a transmission line that is coupled to the resonator at a first junction and at a second junction with a length θ of transmission line running between the two couplings. The configuration provides two signal paths so that constructive interference occurs at the spurious resonance, and destructive interference occurs at a fundamental bandstop frequency. This provides spurious suppression by effectively cancelling out resonator couplings via the constructive interference, extending the upper passband of the bandstop filter to any degree required by the application.

18 Claims, 7 Drawing Sheets

FIXED AND VARACTOR-TUNED BANDSTOP FILTERS WITH SPURIOUS SUPPRESSION

CROSS-REFERENCE TO RELATED APPLICATIONS

This Application claims the benefit of U.S. Provisional Application 61/510,295 filed on Jul. 21, 2011 and incorporated herein by reference.

FIELD OF THE INVENTION

The invention is directed to a bandstop filter, and more particularly to a bandstop filter having a configuration where the resonator is coupled twice to a transmission line to minimize spurious responses.

BACKGROUND OF THE INVENTION

Bandstop filters are needed in many RF and microwave systems where they are used primarily to excise foreign interferers and mitigate co-site interference. In the case of wideband systems it essential that this filtering is achieved without sacrificing bandwidth, which requires that the bandstop filters possess wide passbands free of spurious responses. Unlike bandpass filters, where the upper stopband can be readily extended with the use of a lowpass filter, extending the passband of bandstop filters is a much more difficult problem.

The method typically used to extend the passband of a bandstop filter is to shift the higher-order resonances up in frequency with the use of stepped-impedance or lumped-element-loaded resonators. This approach has successfully been used to extend the pass and up to 6 times the fundamental frequency, e.g. as described in R. Levy, R. V. Snyder, and S. Shin, "Bandstop filters with extended upper passbands," IEEE Trans. Microwave Theory Tech., vol. 54, pp. 2503-2515 (June 2006), but much beyond this the extreme physical dimensions of the resonators becomes a practical limitation.

It is therefore desirable to provide an approach that extends even further the upper passband to suppress the higher-order spurious resonances.

BRIEF SUMMARY OF THE INVENTION

According to the invention, a bandstop filter configured to suppress a spurious resonance frequency includes a resonator and a transmission line that is coupled to the resonator at a first junction and at a second junction with a length θ of transmission line running between the two couplings. The configuration provides two signal paths so that constructive interference occurs at the spurious resonance, and destructive interference occurs at a fundamental bandstop frequency.

The invention achieves spurious suppression by effectively cancelling out resonator couplings using a constructive interference technique, extending the upper passband of bandstop filters and which in theory can be used to extend the passband indefinitely. This is applicable to both fixed-tuned and varactor-tuned bandstop filters. The fixed-tuned bandstop filter achieves a stopband rejection of over 50 dB with an upper passband extending to over 9 times the fundamental frequency. The varactor-tuned bandstop filter achieves a 56% center-frequency tuning range with a passband extending 8.9 times the lowest-tuned center frequency.

The invention provides bandwidth tuning that is accomplished with the same tuning elements used to tune the center frequency; unlike other bandwidth-tuning approaches, the invention allows the bandwidth to be tuned down to zero (intrinsically-switched); and its intrinsic switching functionality allows for less transmission loss compared to external semiconductor switches.

DETAILED DESCRIPTION OF THE INVENTION

Figure 1A:
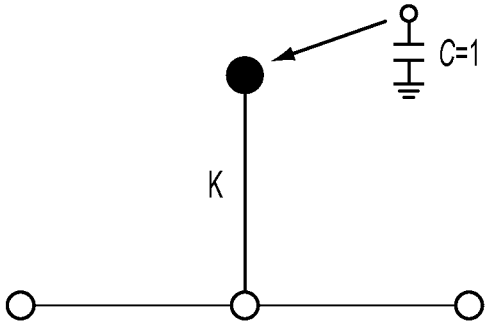
FIG. 1A PRIOR ART
FIG. 1A is a prior art 1st-degree highpass prototype section and FIG. 1B is a 1st-degree highpass prototype section according to the invention.

Shown in FIG. 1A is a highpass prototype of a conventional 1st-degree bandstop section, comprised of a resonator coupled to a transmission line. The coupling is modeled with an admittance inverter K. If this resonator was realized using distributed elements, the higher-order resonant modes would manifest as spurious responses in the upper passband.

Figure 1B:
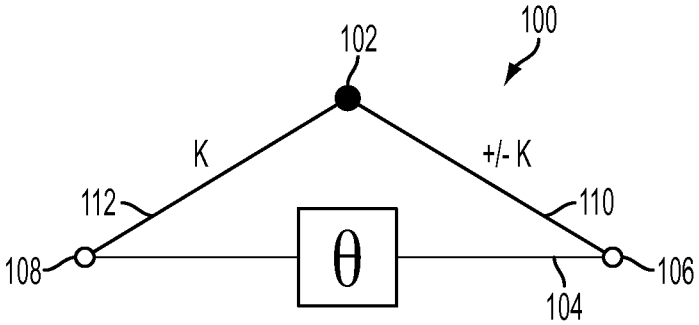

Referring now to FIG. 1B, in one embodiment a bandstop filter system 100 that provides spurious suppression comprises a resonator 102 coupled to a transmission line 104 twice, at junctions 106 and 108, across an electrical length θ. Coupling the resonator 102 to the transmission line 104 twice effectively forms two signal paths 110 and 112, and depending on the value of θ either destructive or constructive interference can result. Also note that the two couplings K may be opposite in sign, depending on the coupling mechanism and topology of the resonator used. Using even/odd-mode analysis the 3-dB bandwidth of this section can be shown to be:

Case 1 (couplings K are the same sign):

$$BW=4K^2\cos^2 0/2 \quad (1)$$

Case 2 (couplings K have opposite sign):

$$BW=4K^2\sin^2 0/2 \quad (2)$$

Assume for the moment that both couplings K have the same sign, and so the bandwidth is given by (1). Eq. 1 is a maximum when θ is an integer multiple of 360°:

$$\theta=2\pi n,\ n=\{0,1,2\ldots\} \quad (3)$$

Under this condition the phase difference between the two signal paths is 180° and maximum destructive interference occurs, resulting in maximum stopband bandwidth for a given coupling K. Eq. 1 is zero (and thus the coupling to the resonator is effectively cancelled) when 0 is an odd multiple of 180°:

$$\theta=\pi n,\ n=\{1,3,5\ldots\} \quad (4)$$

Under this condition the two paths are in phase and maximum constructive interference occurs. When the couplings K are of opposite sign, the bandwidth is given by (2) and condition (3) results in minimum and (4) results in a maximum.

In order to suppress an unwanted spurious resonance the length of the transmission line between the two couplings is chosen such that constructive interference occurs at the spurious frequency, while destructive interference occurs at the fundamental bandstop frequency.

To demonstrate the spurious suppression concept a fixed-tuned bandstop filter consisting only of distributed elements was design, built, and tested. The 2nd and 3rd-order spurious responses of a stepped-impedance resonator are suppressed using constructive interference, which is implemented with both a delay line as well as with distributed coupling.

Figure 2A:
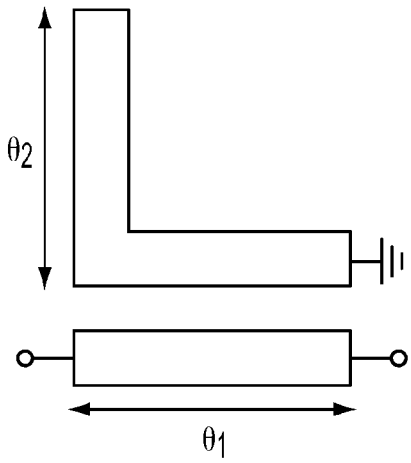
FIG. 2A shows a constructive interference implemented with distributed coupling in an L-shaped side-coupled combline bandstop resonator and FIG. 2B shows a constructive interference implemented with a simplified equivalent circuit at a suppressed spurious frequency.
Figure 2B:
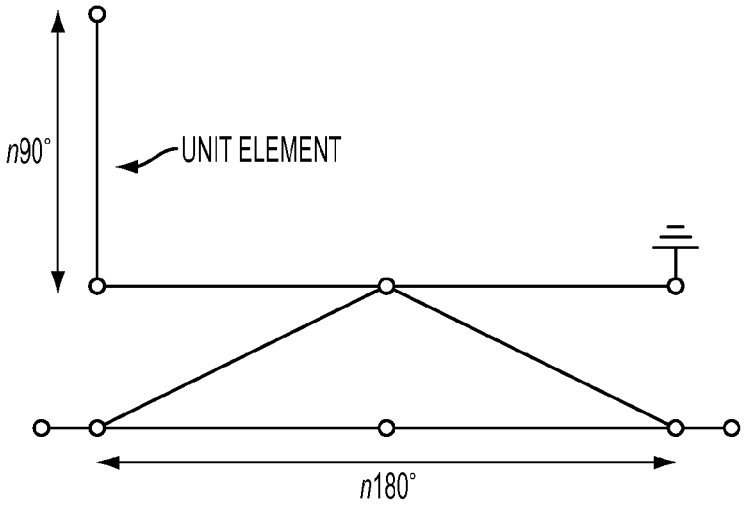

FIGS. 2A-B illustrate how distributed coupling can be used to implement constructive interference. FIG. 2A is an L-shaped combline resonator side coupled to a transmission line, with the coupled and uncoupled lengths given by $\theta_1$ and $\theta_2$, respectively. The fundamental resonance occurs at the frequency at which the sum of $\theta_1$ and $\theta_2$ is equal to 90°. If $\theta_1$ and $\theta_2$ are chosen such that, at a given spurious frequency, $\theta_1$ is an odd multiple of 180° and $\theta_2$ is an odd multiple of 90°, the equivalent circuit shown in FIG. 1B is valid (see, e.g., R. Sato and E. G. Cristal, "Simplified analysis of coupled transmission-line networks," IEEE Trans. Microwave Theory Tech., vol. 18, pp. 122-131 (March 1970)) (at the spurious frequency). FIG. 2B consists of two in-phase signal paths, resulting in constructive interference and so the spurious is effectively cancelled. In other words, spurious suppression is achieved by decoupling a bandstop combline resonator in such a way that at a given spurious frequency it becomes equivalent to a 180° resonator coupled along its entire length.

Figure 3:
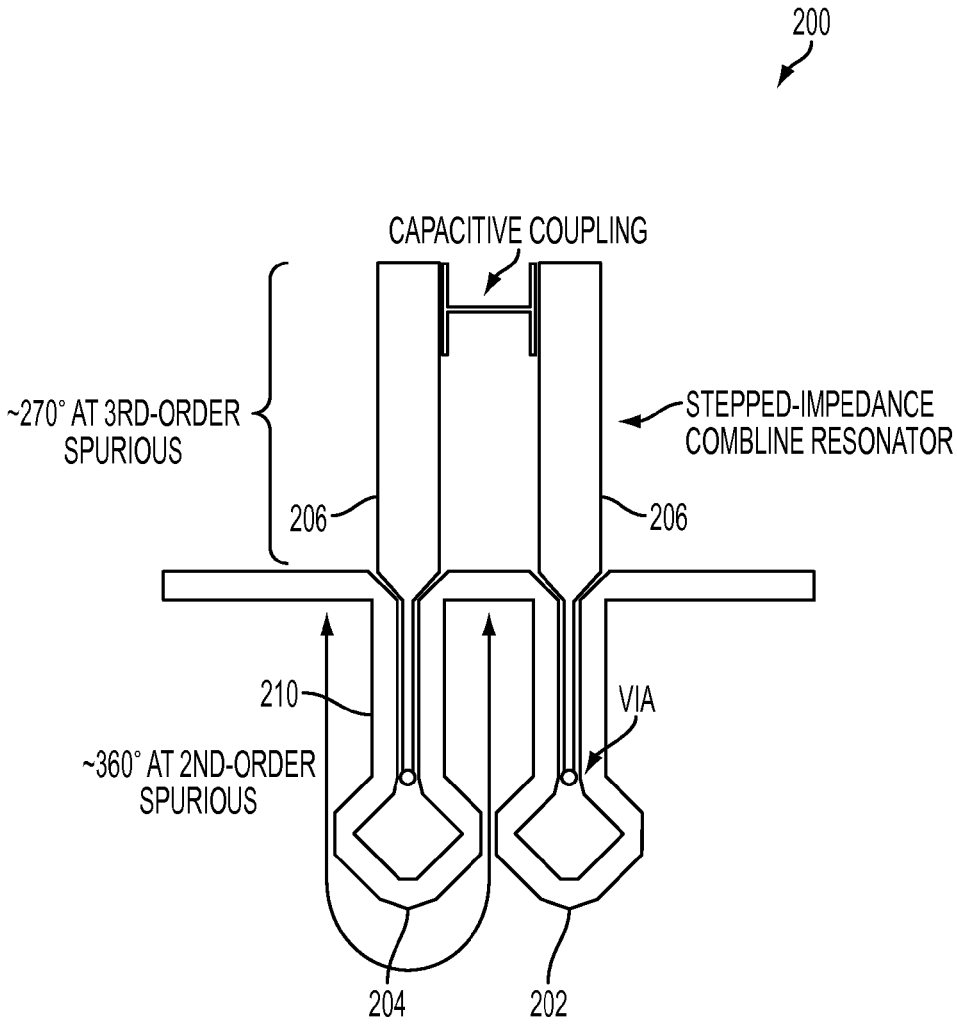
FIG. 3 is a schematic representation of a fixed-tuned bandstop microstrip according to the invention.

Shown in FIG. 3 is the layout of the 2nd-degree microstrip filter 200. It consists of two 1st-degree bandstop sections 202 and 204 in cascade, each of which is comprised of a stepped-impedance combline resonator 206 coupled to a transmission line 208 such that the input impedance looking into the uncoupled length of resonator becomes a short at the 3rd-order spurious frequency. The 2nd-order spurious is suppressed by coupling the resonator to the transmission line 210 twice across an electrical length equal to approximately 360° at the 2nd-order spurious frequency. There exists inductive coupling between the two resonators which is utilized to increase the stopband attenuation by adding destructive interference (see, e.g., D. R. Jachowski and A. C. Guyette, "Sub-octave-tunable notch filter," IEEE International Symposium on Electromagnetic Compatibility, pp. 99-102 (Aug. 2009)). This inductive coupling is controlled by adding a small amount of capacitive coupling between the open ends of the resonators.

Figure 4A:
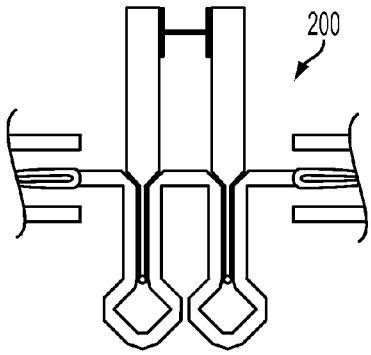
FIG. 4A is a microstrip fixed-tuned bandstop filter with extended passband in the form of a Fabricated circuit as in the invention.
Figure 4B:
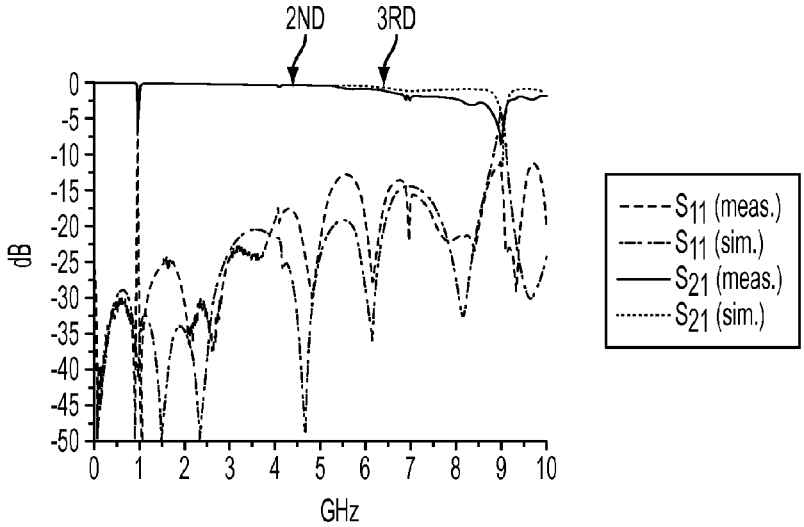
FIG. 4B shown the broadband response of FIG. 4A.
Figure 4C:
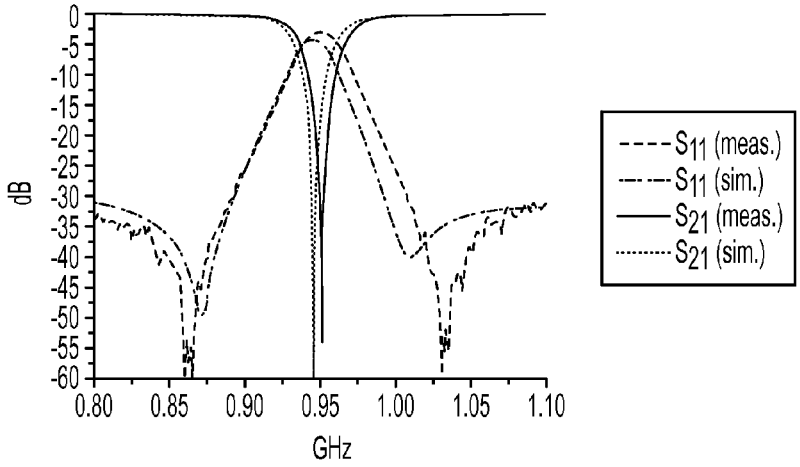
FIG. 4C shows the narrowband bandstop response of FIG. 4*a;*

Shown in FIG. 4A is the fabricated circuit of the layout of FIG. 3 (30-mil Rogers Duroid 3003, milled with an LPKF Protomat S62). Shown in FIG. 4 and FIG. 4C are the wide- and narrow-band measured results, respectively. The fundamental bandstop response has a bandwidth of 38.9 MHz, a center frequency 951.5 MHz, and 54 dB of stopband attenuation. The spurious responses occurring at 4.05 GHz and 6.91 GHz are successfully suppressed leaving small (<0.5 dB) insertion loss dips occurring at those frequencies. The first unsuppressed response occurs at 8.94 GHz, resulting in a passband extending to more than 9 times the fundamental bandstop center frequency. The only post-fabrication tuning done was to adjust the capacitive coupling between the resonators to improve the notch depth. No tuning was required for spurious cancellation.

Figure 5A:
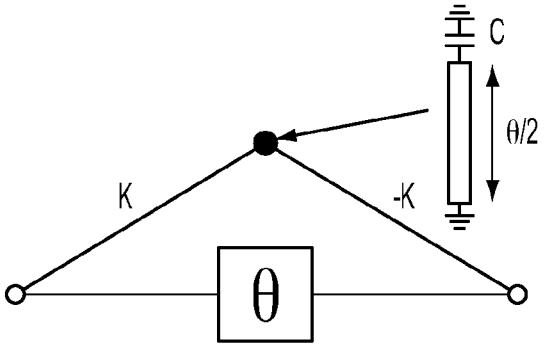
FIG. 5A shows a circuit topology using capacitive loading to shift the spurious resonances of a combline resonator to coincide with the bandwidth nulls obtained constructive interference as in the invention.
Figure 5B:
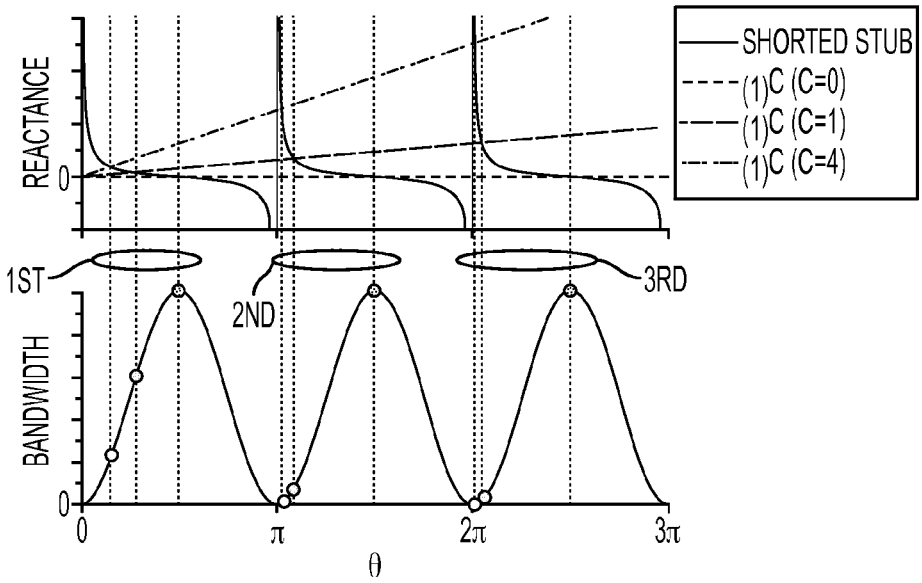
FIG. 5B is a plot showing how resonances shift for various values of capacitance.

The constructive interference concept can also be used to suppress spurious responses in varactor-tuned bandstop filters. The idea is to utilize capacitive loading to shift the unwanted higher-order resonances down in frequency to coincide with the bandwidth nulls provided by constructive interference. FIGS. 5A-B illustrate the basic concept. The higher-order resonances are increasingly shifted into the bandwidths nulls as frequency increases due to the increasing reactance of the lumped capacitance. In theory this results in the suppression of an infinite number of spurious responses. In practice this is limited by the parasitics of a real capacitor.

Figure 6:
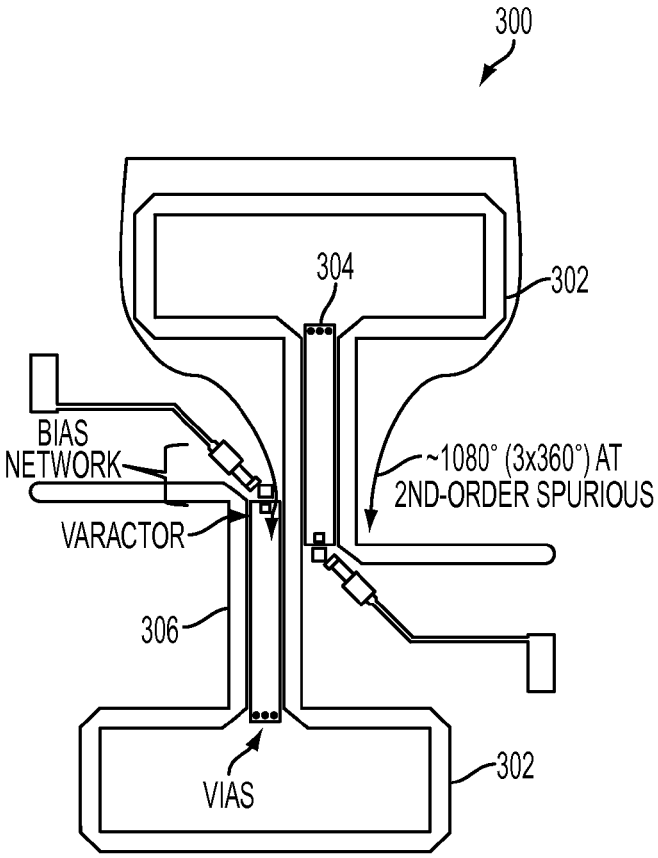
FIG. 6 is a schematic representation of a varactor-tuned bandstop microstrip according to the invention.

Shown in FIG. 6 is the layout of a 2nd-degree microstrip varactor-tuned filter 300 in SONNET. Similar to the fixed-tuned filter it consists of two 1st-degree bandstop sections 302 in cascade. Each bandstop section 302 is comprised of a varactor-loaded combline resonator 304 coupled twice to a transmission line 306 across an electrical length equal to approximately 1080° (3×360°) at the frequency of the 2nd-order spurious response at 4.5 GHz. This length was chosen as it also creates a bandwidth null at 1.5 GHz which is right above the tuning range, allowing for a more constant absolute bandwidth vs. center frequency. As in the fixed-tuned filter, a small amount of coupling between the resonators is utilized to improve the stopband rejection.

Figure 7A:
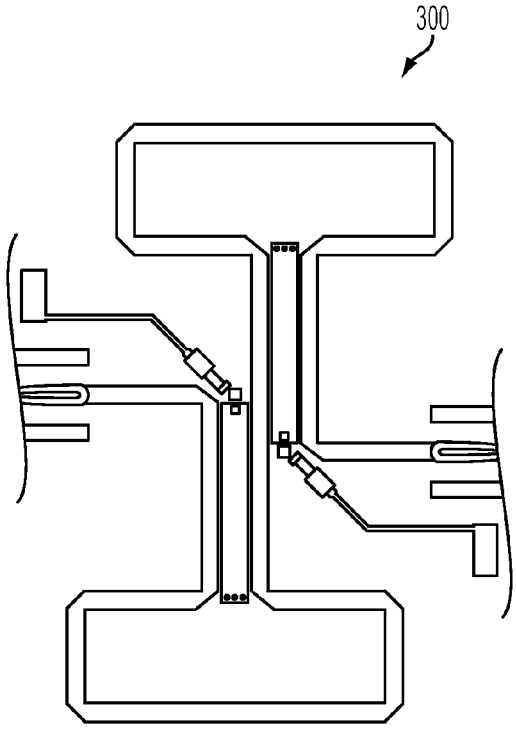
FIG. 7A is a fabricated microstrip varactor-tuned bandstop filter circuit with extended stopband as in the invention.
Figure 7B:
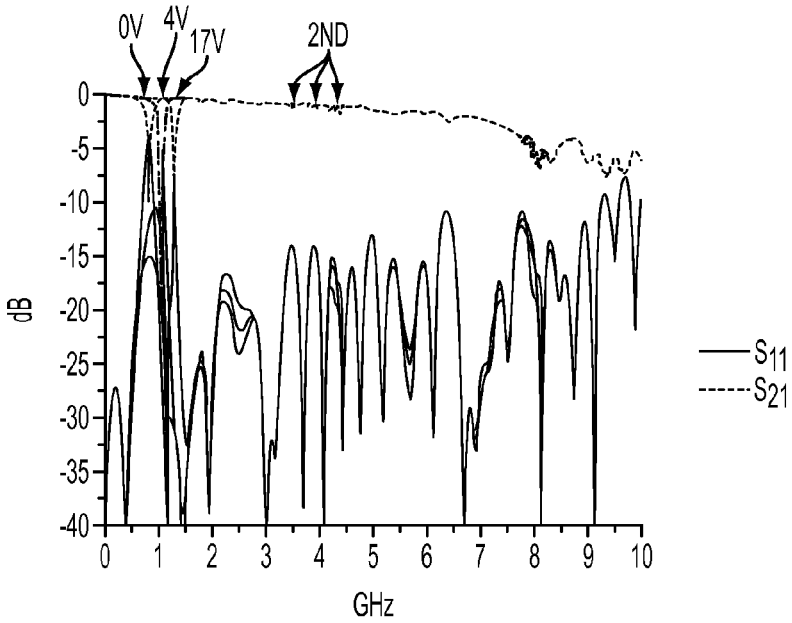
FIG. 7B shows the broadband response for three varactor tuning voltages for FIG. 7A.

Shown in FIG. 7A is the fabricated circuit of the layout of FIG. 6 (30-mil Rogers Duroid 3003, milled with an LPKF Protomut S62). The varactors are unpackaged Mlicrosemi MV21010 abrupt junction (Cj=2.05-4.45 pF) wire bonded to minimize parasitics. Shown in FIG. 7B are the measured results for three tuning voltages. The center frequency tunes from 838.3 MHz to 1308.6 MHz (56%) while the 3-dB bandwidth varies from 62.6 MHz at the highest-tuned center frequency to 99.1 MHz at the lowest (+/−22%). The stopband rejection varies from 10 dB to 22 dB. The passband extends to 7.47 GHz, which is 5.7 times the fundamental at highest-tuned frequency and 8.9 times the fundamental at lowest-tuned frequency.

Although the invention has been described above in relation to preferred embodiments thereof, it will be understood by those skilled in the art that variations and modifications can be effected in these preferred embodiments without departing from the scope and spirit of the invention.

What is claimed as new and desired to be protected by Letters Patent of the United States is:

1. A bandstop filter configured to suppress a spurious resonance frequency, comprising:

a resonator; and a transmission line coupled to the resonator at a first junction and at a second junction defining a length θ of transmission line therebetween, thereby defining two signal paths such that constructive interference occurs at the spurious resonance frequency and destructive interference occurs at a fundamental bandstop frequency to thereby suppress the spurious resonance frequency, ad wherein the couplings have a sign $$BW=4K^2\cos^2 0/2 \quad \text{Equation (1)}$$

where BW is the bandwidth and K is the coupling coefficient.

2. The bandstop filter of claim 1, wherein $$\theta \text{ is an integer multiple of } 360°\ \theta=2\pi n,\ n=\{0,1,2\ldots\}$$

and

Equation (1) is at a maximum so that a phase difference between the two signal paths is 180° and maximum destructive interference occurs, resulting in a maximum stopband bandwidth for the respective coupling.

3. The bandstop filter of claim 1, wherein the bandstop filter is a microstrip configuration.

4. A bandstop filter configured to suppress a spurious resonance frequency, comprising:

a resonator; and a transmission line coupled to the resonator at a first junction and at a second junction defining a length θ of transmission line therebetween, thereby defining two signal paths such that constructive interference occurs at the spurious resonance and destructive interference occurs at a fundamental bandstop frequency to thereby suppress the spurious resonance frequency, and wherein the couplings have opposite signs $$BW=4K^2 \sin^2 0/2 \qquad \text{Equation (2)}$$

where BW is the bandwidth and K is the coupling coefficient.

5. The bandstop filter of claim 4, wherein θ is an odd multiple of 180°

$$\theta=\pi n,\ n=\{1,3,5\ldots\} \text{ and}$$

Equation (2) is at a maximum so that a phase difference between the two signal paths is 180° and maximum destructive interference occurs, resulting in maximum stopband bandwidth for the respective coupling.

6. The bandstop filter of claim 4, wherein the bandstop filter is a microstrip configuration.

7. A second-degree bandstop filter, comprising:

two 1st-degree bandstop sections mutually coupled in a cascade configuration and wherein each said section comprises:

a stepped-impedance combline resonator, and a transmission line coupled to the resonator at a first junction and at a second junction defining a length θ of transmission line therebetween, thereby defining two signal paths such that constructive interference occurs at the spurious resonance and destructive interference occurs at a fundamental bandstop frequency to thereby suppress the spurious resonance frequency.

8. The bandstop filter of claim 7, wherein the couplings have a sign $$BW=4K^2 \cos^2 0/2 \qquad \text{Equation (1)}$$

where BW is the bandwidth and K is the coupling coefficient.

9. The bandstop filter of claim 8, wherein $$\theta \text{ is an integer multiple of } 360°\ \theta=2\pi n,\ n=\{0,1,2\ldots\}$$

and

Equation (1) is at a maximum so that a phase difference between the two signal paths is 180° and maximum destructive interference occurs, resulting in a maximum stopband bandwidth for the respective coupling.

10. The bandstop filter of claim 7, wherein the couplings have opposite signs $$BW=4K^2 \sin^2 0/2 \qquad \text{Equation (2)}$$

where BW is the bandwidth and K is the coupling coefficient.

11. The bandstop filter of claim 10, wherein θ is an odd multiple of 180°

$$\theta=\pi n,\ n=\{1,3,5\ldots\} \text{ and}$$

Equation (2) is at a maximum so that a phase difference between the two signal paths is 180° and maximum destructive interference occurs, resulting in maximum stopband bandwidth for the respective coupling.

12. The bandstop filter of claim 7, wherein each section is a microstrip configuration.

13. A second-degree bandstop filter, comprising:

two 1st-degree bandstop sections mutually coupled in a cascade configuration and wherein each said section comprises:

a varactor-loaded combline resonator, and a transmission line coupled to the resonator at a first junction and at a second junction defining a length θ of transmission line therebetween, thereby defining two signal paths such that constructive interference occurs at the spurious resonance and destructive interference occurs at a fundamental bandstop frequency to thereby suppress the spurious resonance frequency.

14. The bandstop filter of claim 13, wherein the couplings have a sign $$BW=4K^2 \cos^2 0/2 \qquad \text{Equation (1)}$$

where BW is the bandwidth and K is the coupling coefficient.

15. The bandstop filter of claim 14, wherein $$\theta \text{ is an integer multiple of } 360°\ \theta=2\pi n,\ n=\{0,1,2\ldots\}$$

and

Equation (1) is at a maximum so that a phase difference between the two signal paths is 180° and maximum destructive interference occurs, resulting in a maximum stopband bandwidth for the respective coupling.

16. The bandstop filter of claim 13, wherein the couplings have opposite signs $$BW=4K^2 \sin^2 0/2 \qquad \text{Equation (2)}$$

where BW is the bandwidth and K is the coupling coefficient.

17. The bandstop filter of claim 16, wherein θ is an odd multiple of 180°

$$\theta=\pi n,\ n=\{1,3,5\ldots\} \text{ and}$$

Equation (2) is at a maximum so that a phase difference between the two signal paths is 180° and maximum destructive interference occurs, resulting in maximum stopband bandwidth for the respective coupling.

18. The bandstop filter of claim 13, wherein each section is a microstrip configuration.

* * * * *